United States Patent [19]

Bruehler

[11] Patent Number: 4,621,451

[45] Date of Patent: Nov. 11, 1986

[54] ACTUATING AND LOCKING MECHANISM FOR SLIDING DOOR

[76] Inventor: Arthur Bruehler, 1732 Center Rd., Avon, Ohio 44011

[21] Appl. No.: 787,081

[22] Filed: Oct. 15, 1985

[51] Int. Cl.[4] ..... E05B 47/00

[52] U.S. Cl. ..... 49/15; 49/13; 49/18; 49/139; 49/412

[58] Field of Search ..... 49/13–18, 49/139, 140, 412

[56] References Cited

U.S. PATENT DOCUMENTS

| | | | |
|---|---|---|---|
| 3,271,901 | 9/1966 | Bednar | 49/16 X |
| 3,426,478 | 2/1969 | Sturges et al. | 49/16 |
| 3,564,772 | 2/1971 | Ozler et al. | 49/15 |
| 3,830,017 | 8/1974 | Markham | 49/18 |
| 3,866,354 | 2/1975 | Butt | 49/16 |

*Primary Examiner*—Kenneth Downey

*Attorney, Agent, or Firm*—Renner, Otto, Boisselle & Lyon

[57] ABSTRACT

An actuation and locking mechanism for sliding prison doors or the like includes a pivotal motor assembly, a movable carriage assembly reciprocally driven by the motor assembly and carrying the door, a drop bar assembly for locking or unlocking the carriage assembly and door, control means for actuating the motor and drop bar assembly as required to open, close, lock or unlock the door, emergency release and means manually to disengage or engage the drop bar assembly and pivotal motor assembly to allow the door to be manually opened, locked opened, closed or locked closed. The components of the actuating and locking mechanism are easily installed and serviced, may be universally used for right or left hand doors with minor electrical modifications, may be readily incorporated in multiple door systems and are concealed in a fail safe mode.

29 Claims, 8 Drawing Figures

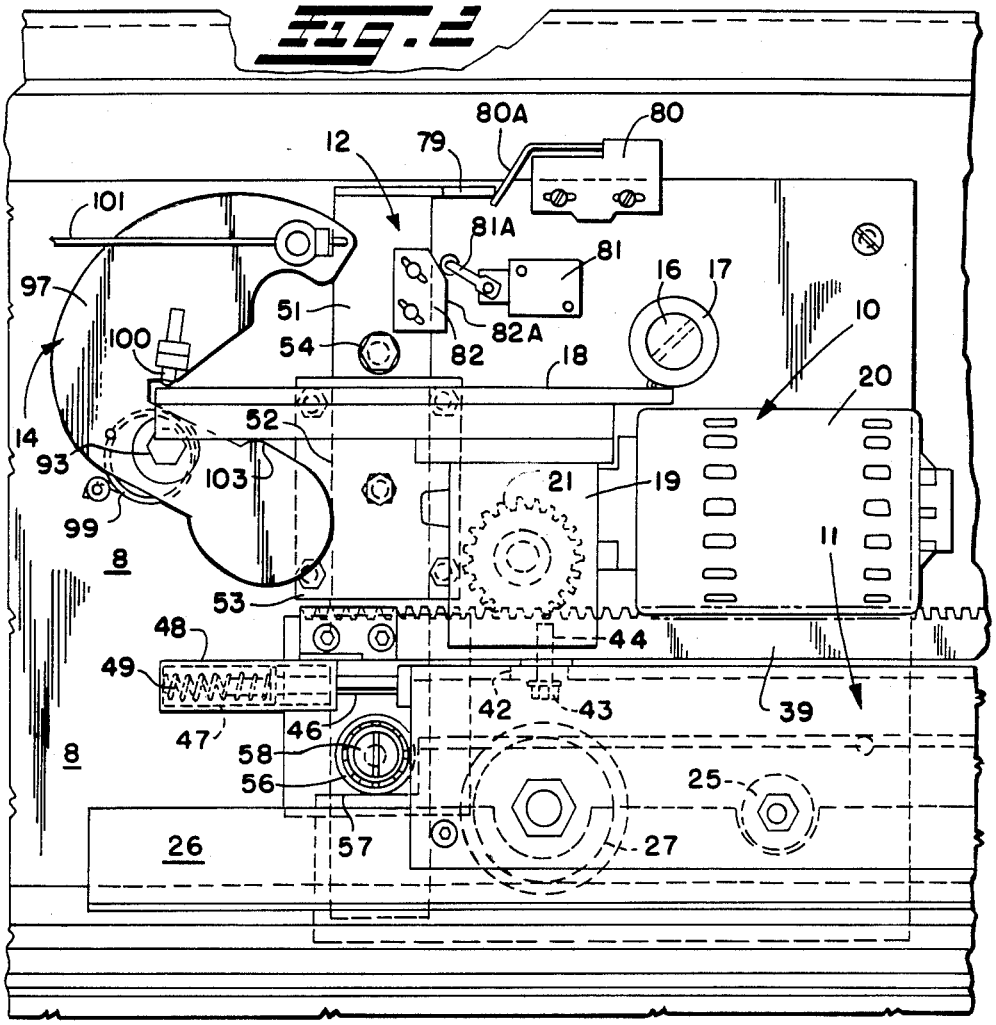
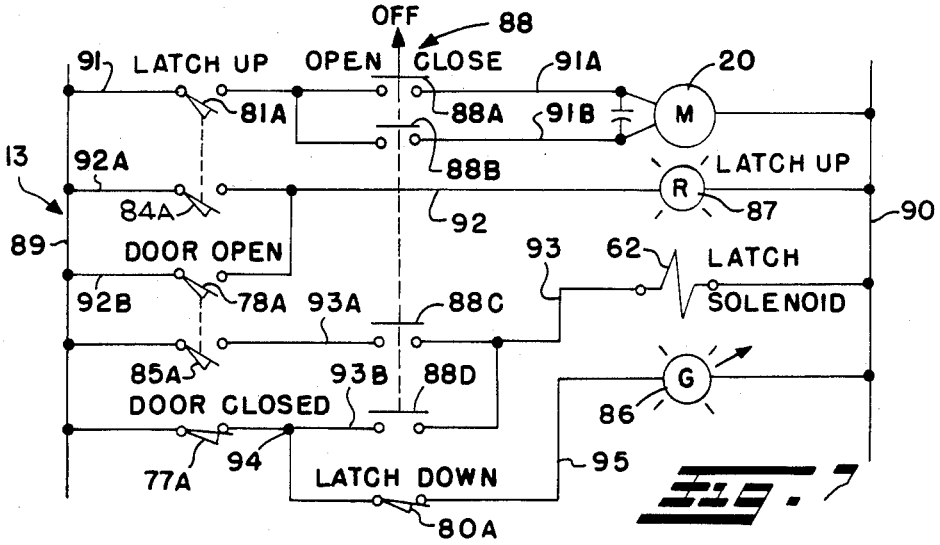
FIG. 7

ACTUATING AND LOCKING MECHANISM FOR SLIDING DOOR

FIELD OF THE INVENTION

The present invention generally relates to an actuation and locking mechanism for sliding doors and specifically relates to an easily assembled and serviced, normally concealed locking and actuation mechanism for prison doors.

BACKGROUND OF THE INVENTION

Actuating and locking mechanisms for sliding prison doors are well known. Examples of actuation and locking devices for sliding prison doors are shown in Young U.S. Pat. No. 3,009,545; Adam U.S. Pat. No. 3,107,967; Browning, U.S. Pat. No. 3,053,352; Young U.S. Pat. No. 3,082,847; Wallmann U.S. Pat. No. 3,127,160; Bednar U.S. Pat. No. 3,271,901; Browning U.S. Pat. No. 3,343,302; Sturges U.S. Pat. No. 3,426,478; Ozier U.S. Pat. No. 3,564,772; Browning U.S. Pat. No. 3,571,974; Lentz U.S. Pat. No. 3,675,369; Markham U.S. Pat. No. 3,830,017; Butt U.S. Pat. No. 3,837,117; and Butt U.S. Pat. No. 3,913,263.

Generally speaking, the actuation and locking mechanisms disclosed in the noted patents and provided in commercially available prison doors are relatively complicated in their structures. This complexity of structure may result in periodic structural problems or inoperability. Moreover, this complexity in structure and function creates installation and service problems resulting in increased installation and service costs and in increased down time. The complexity in structure and function may also result in higher purchase prices to penal institutions or to other owners of sliding door installations.

SUMMARY OF THE PRESENT INVENTION

To overcome the disadvantages of the relatively complicated prior art actuation and locking mechanisms, the principle object of the present invention is to provide a structurally simplified locking and actuation mechanism for prison doors and the like that may be easily installed and readily serviced. To this end, the principle components of the actuation and locking mechanism of the present invention are contained and readily accessible in the normally closed transom immediately above the sliding door. The actuation and locking mechanism has components that can be readily removed and/or replaced.

Yet another object of the present invention is to provide a simplified actuation and locking mechanism for sliding doors wherein the mechanism components are substantially fully concealed to minimize tampering and contaminant entry. To this end, the elongated slots in the transom and associated structure are continuously covered by the door and/or by a slide plate cooperating with the door. Similarly, with respect to the lower door lock, the plunger mechanism is substantially covered to minimize tampering, and the lower lock actuator is slip fit relative to the drop bar assembly to permit relative movement therebetween without effecting the locking and actuation structure in the transom.

It is still another object of the present invention to provide an emergency release capability allowing the door to be opened, closed, locked or unlocked when power is interrupted or when circuit failures occur. The emergency release system is manually operative and releases motor drive engagement and unlatches both locks of the drop bar locking assembly. Upon deactuation, the emergency release system is spring biased to return the motor assembly and push bar assembly to their normal operative positions for automatic control.

It is still a further object of the present invention to provide a drop bar assembly that operates in the fail safe mode. For this purpose, the solenoid actuation of the drop bar assembly raises the same to its unlatched position unlocking both the upper and lower locks. Deactuation of the solenoid then results in the drop bar assembly falling to its locked mode unless otherwise mechanically restricted.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DESCRIPTION OF THE DRAWINGS

In the drawings:

FIG. 2 is an enlarged elevation of the pivotal motor assembly, drop bar assembly, carriage assembly and emergency release lever assembly for the actuation and locking mechanism of the present invention;

FIG. 7 is an electrical schematic of the controls for the actuation and locking mechanism of the present invention shown in the door fully closed and locked condition.

DETAILED DESCRIPTION OF THE PREFERRED EMBODIMENT

Figure 1:
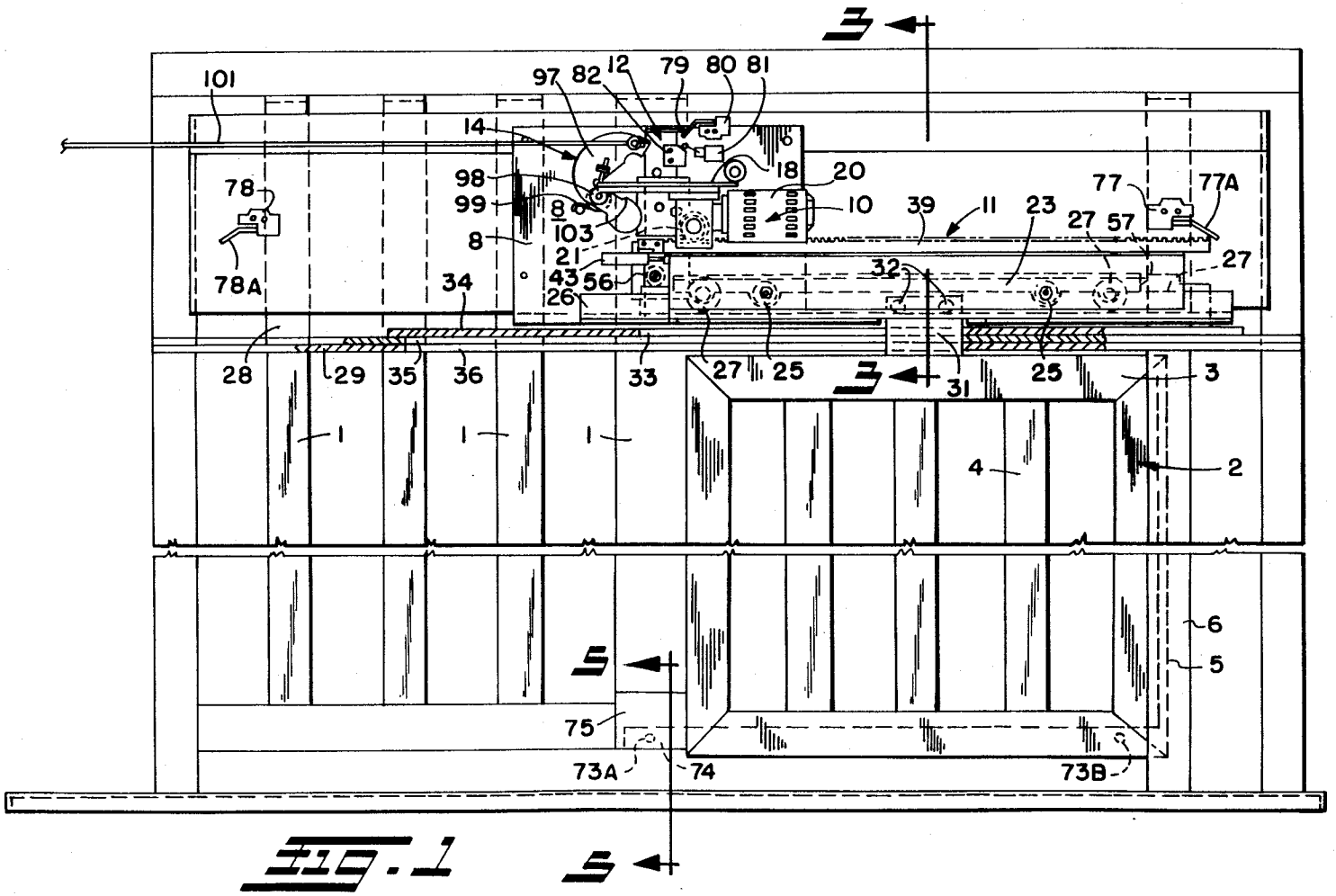
FIG. 1 is a front elevation partially broken away and partially in section of a prison door in its fully closed position with the front wall of the transom being removed to show the details of the actuation and locking mechanism of the present invention.

Turning now to the drawings and initially to FIG. 1, the prison cell includes a front wall enclosed by vertically extending and laterally spaced fixed hollow bars 1 and by a slidable prison door, indicated generally at 2. The prison door 2 includes a peripheral frame work 3 supporting vertically extending and horizontally spaced bars 4 with the bottom of the door spaced above the floor for operating and assembly clearance. The right hand end of door 2 as viewed in FIG. 1 can be received in a pocket 5 in the door jam 6 when the door is closed to conceal the end of the door. The slidable door 2 may selectively be laterally slid between its closed position shown in FIG. 1 and an open position in which the door 2 is located immediately in front of the fixed bars 1 to allow ingress to or egress from the cell. Although a prison door with bars is shown by way of example, it will be appreciated that the present invention may be used with solid prison doors with or without windows or with any other sliding door system.

The lateral sliding movement of door 2 between open and closed positions and locking the door 2 in either of such positions is provided by the actuation and locking mechanism of the present invention. The locking and actuation mechanism is enclosed in a transom 7 positioned above the fixed bars 1 and sliding door 2. A mounting plate 8 is releasably connected to the back wall 9 of the transom to provide a supporting surface for mounting the components of the actuation and locking mechanism of the present invention. The components of the mechanism include a pivotal motor assembly indicated generally at 10, a carriage assembly indicated generally at 11, a drop bar assembly indicated generally at 12, a control circuit indicated generally at 13, and an emergency release assembly indicated generally at 14. Each of the respective assemblies will be described below followed by a description of the operation of the actuation and locking mechanism for the prison door.

Pivotal Motor Assembly 10

Figure 3:
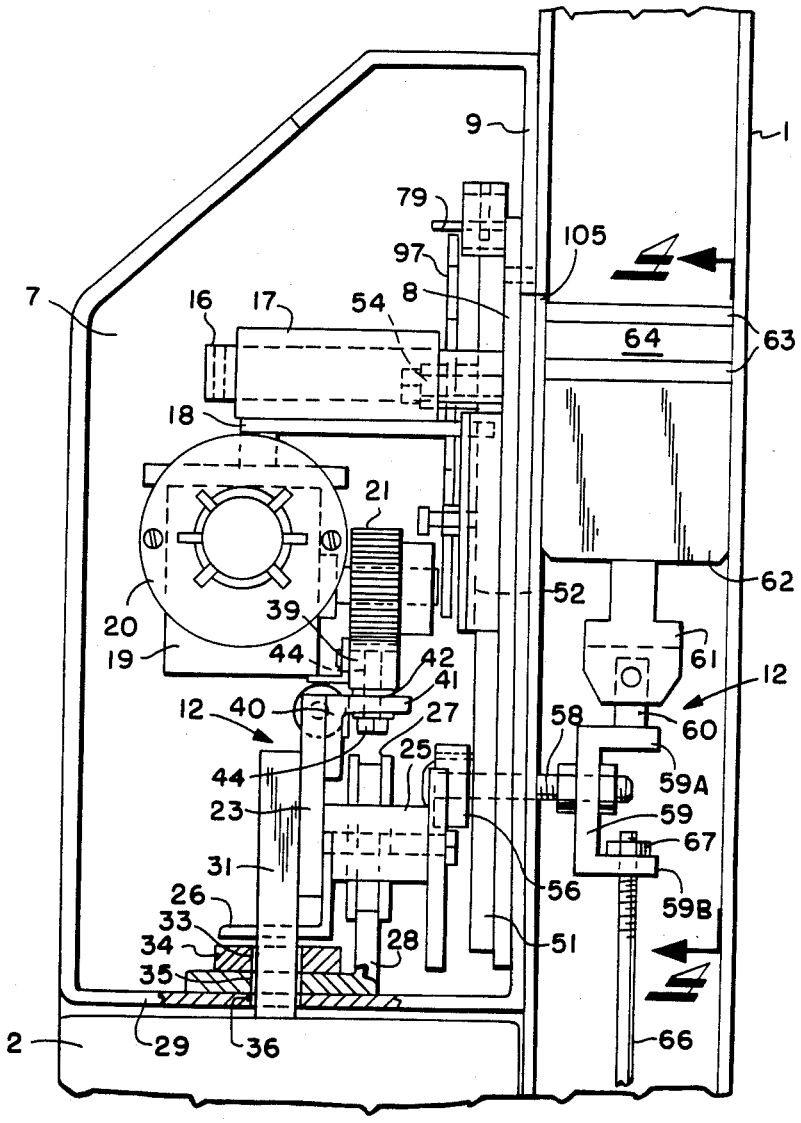
FIG. 3 is a side cross section taken along the plane 3—3 in FIG. 1 illustrating the hanger for suspending the door from the carriage assembly and the solenoid for actuating the drop bar assembly.

As best shown in FIGS. 2 and 3, the pivotal motor assembly 10 includes a pivot shaft 16 connected to and extending forwardly from mounting plate 8. An annular pivot collar 17 surrounds pivot shaft 16 and can be pivotally moved relative to the same. A motor base 18 is welded to the bottom of sleeve 17 and pivots with the sleeve 17. A gear reducer 19 is connected to and suspended below the motor base 18, with the motor 20 being mounted in cantilever relationship from the gear reducer 19. The motor 20 through gear reducer 19 drives a pinion 21 operatively associated with the carriage assembly indicated generally at 11.

Carriage Assembly 11

As best shown in FIG. 3, the laterally movable carriage assembly 12 includes a laterally extending and vertically oriented front plate 23 in spaced parallel relation to a laterally extending vertical back plate 24. The front plate 23 and back plate 24 are fixably held in spaced parallel relationship to one another by spacers 25. A stabilizer angle 26 may be connected to the carriage assembly to minimize tipping or rocking during carriage movement.

Two laterally spaced wheels 27 are rotatably mounted to the front plate 23 and positioned between the front and back plates 23 and 24, respectively. The wheels 27 have central annular grooves with these grooves respectively receiving the upper end of track angle 28. The lower web of track angle 28 is mounted to the bottom wall 29 of transom 7 to support the carriage assembly 12 from the transom while allowing guided, sliding movement of the carriage assembly relative to the transom as provided by the wheels 27 rolling along track 28.

The selective lateral movement of carriage assembly 11 results in opening or closing movement of door 2. To this end, the front face of the front plate 23 has a hanger 31 removably centrally connected thereto by fasteners 32, as best shown in FIG. 1. The hanger 31 extends downwardly through an elongated slot 33 in slide member 34, an elongated slot 35 in track angle 28 and an elongated slot 36 in bottom wall 29 of transom 7. The lower end of hanger 31 has the door 2 suspended therefrom for movement therewith.

The door 2 is in closely spaced relation to the bottom wall 29 of transom 7 to conceal the slots 33, 35 and 36 thereabove when the door is in its closed position as shown in FIG. 1 with the slots 35 and 36 to the left of closed door 2 being covered by slide member 34 as illustrated in FIG. 1.

When the door is opened, the slide plate 34 cooperates with the door 2 to conceal the slots leading to the transom. As best shown in FIG. 1, the lengths of the slots are coordinated with respect to one another to allow the slots 35 and 36 to be covered as required by the slide plate 34 during the door opening. As the prison door 2 moves to the left as viewed in FIG. 1, the door itself will cover the slots to the right of fixed bars 1 until half of its travel is completed. At this point, the left end of hanger 31 engages the left end of slot 33 in slide member 34 and thereafter slide member 34 moves with the door 2. The movement in slide member 34 results in the solid portion of the slide member to the right of the slot 33 as viewed in FIG. 1 progressively covering the slots 35 and 36 in track members 28 and bottom wall 29, respectively.

When the door is returned to its closed position, the hanger 31 will freely move in the aligned slots 33, 35 and 36 until one-half of the door closure movement has occurred. At such point, the right side of hanger 31 will engage the right end of slot 33 and return the sliding member 34 to the position shown in FIG. 1 to a ready condition for the next door movement cycle. The slots 35 and 36 are thus covered at all times during reciprocal door movement by the door 2 in cooperation with slide member 34.

The reciprocal movement of the door between its closed and opened positions is provided by a rack and pinion drive. To this end, a rack 39 is mounted on the top of the carriage assembly 12. As best shown in FIG. 3, an angle 40 is attached to the upper back wall of front plate 23 of the carriage assembly. The horizontal web 41 of angle 40 has two spaced slots 42 therein of limited length. Fasteners 43 pass through the slots 42 into tapped openings 44 in rack 39. The slots 42 provide the rack 39 with limited lateral movement as discussed in more detail below. This lateral movement is normally restrained by a spring.

To this end, the left end of carriage assembly 12 (as viewed in FIGS. 1 and 2) is provided with a laterally extending rod 46 mounted thereto. The left end of rod 46 is received in the bore 47 of cylinder 48. The cylinder 48 is externally connected to the left end of rack 39. A spring 49 is interposed between a shoulder on rod 46 and the blind end of the cylinder bore 47. This spring biases the cylinder 47 to the right as viewed in FIGS. 1 and 2 normally to have the fasteners 43 bottomed against the right end of slots 42 to maintain a fixed position for the rack during normal operation of the rack and pinion drive.

As will be apparent, rotation of pinion 21 in the clockwise direction will drive the rack 39, carriage assembly and door 2 to the left as viewed in FIGS. 1 and 2 to open the door, whereas rotation of the pinion 21 in a counter-clockwise direction will result in the rack, carriage assembly and door being driven to the right to close the door. This rectilinear movement of the carriage assembly to the left or right can be precluded in either the fully closed position of the door 12 as shown in FIG. 1 or in the fully opened position of the door by the drop bar assembly 12.

Drop Bar Assembly 12

The drop bar assembly 12 includes a vertically oriented upper drop bar member 51, which is mounted for vertical movement relative to the mounting plate 8. To this end, upper drop bar 51 is received in and guided by a constraining channel 52 defined in guide cover 53 removably secured to backing plate 8.

The upper drop bar has an emergency release bolt 54 mounted thereon above guide cover 53. This emergency release bolt extends forwardly from upper drop bar 51 above motor base 18 for a purpose to be described in more detail hereinafter in conjunction with the emergency release assembly 14.

Below guide cover 53, the upper drop bar 51 has a roller 56 connected thereto and extending forwardly therefrom. The roller 56 may be selectively received in a cut out shoulder 57 on either upper end of back plate 24 of carriage assembly 11. When the roller 56 is received in the cut out shoulder 57 at the left end of carriage assembly 11 as viewed in FIGS. 1 and 2, the roller 56 precludes the carriage assembly 11 from being driven to the left. Similarly, when the roller 56 is in the cut out 57 at the right end of the carriage assembly 11, which would result with the door 2 fully open, the carriage assembly and door could not be closed since movement to the right would be blocked. The roller 56 may be removed from either cut-out shoulder on the carriage assembly by the drop bar being elevated by a solenoid drive.

To this end, the fastener 58 mounting roller 56 to the upper drop bar 51 extends rearwardly through the back wall of the transom and through an aperture in the fixed hollow tubular prison bar 1 aligned therewith, as best shown in FIG. 3. The shank of fastener 58 is threaded to mount a U-shape connector 59 for the solenoid drive and for the lower drop bar section.

Figure 4:
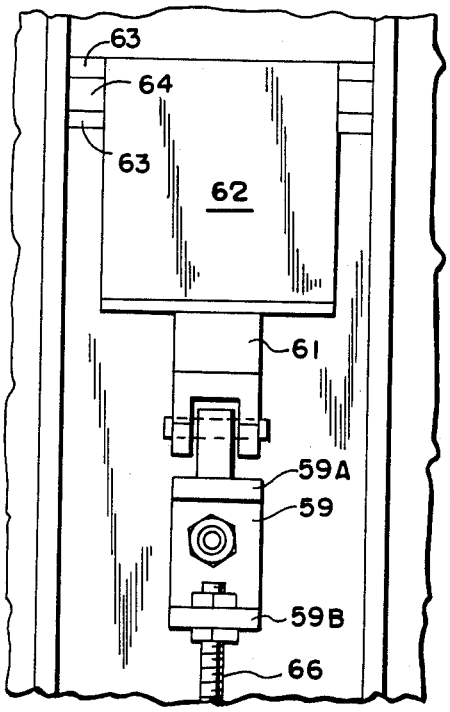
FIG. 4 is rear elevation taken along the plane 4—4 of FIG. 3 showing the solenoid actuation for the drop bar assembly together with the removable slide mounting for the solenoid in the hollow fixed central bar.

The U-shaped connector 59 has two horizontal arms 59A and 59B. The upper arm 59A has a connection tab 60 extending upwardly therefrom to a yoke connection with the solenoid armature 61 extending downwardly from solenoid 62. The solenoid 62 is slidingly mounted in the hollow fixed prison bar 1 by having two spaced shoulders 63 on each side of solenoid 62 slidingly cooperating with a captured rib 64 extending outwardly from each of the opposed walls of prison bar 1, as best shown in FIGS. 3 and 4. The soleniod 62 may thus be readily removed from or mounted in the prison bar 1 by merely sliding the same into or out of position through aligned holes in transom back wall 9 and in the front wall of the fixed prison bar 1.

In operation, energization of solenoid 62 will raise armature 61 resulting in the upper and lower sections of the drop bar being raised. Deenergization of solenoid 62 results in the solenoid armature 61 being free to drop under the force of gravity, unless otherwise mechanically restrained.

The lower section of the drop bar assembly includes a vertically oriented drop rod 66 extending downwardly from arm 59B of U-shaped connector 59 within the center hollow fixed bar 1. The lower drop rod 66 preferably has a slip fit connection with arm 59B by having a nut threaded thereon above arm 59B, without a nut threaded therebelow. However, a fixed connection could also be provided for lower drop bar 66 by having two nuts respectively threaded against opposite sides of the arm 59B.

Figure 5:
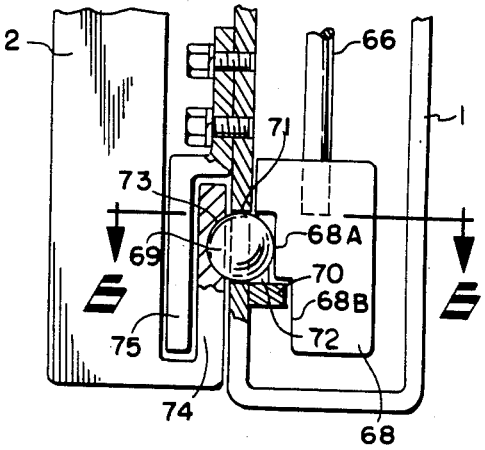
FIG. 5 is a cross section taken along the plane 5—5 of FIG. 1 showing the drop bar assembly actuation of the bottom door lock in the fully closed door position.
Figure 5A:
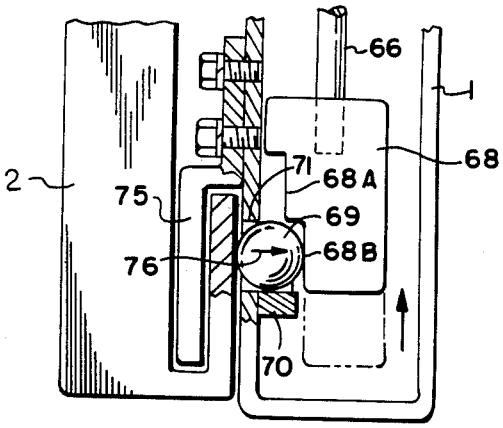
FIG. 5A is a view similar to FIG. 5 showing the unlocked position of the bottom door lock allowing the door to be moved between its open and closed positions.
Figure 6:
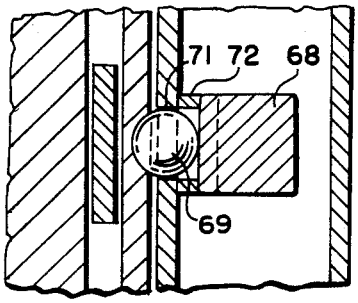
FIG. 6 is a cross section taken along plane 6—6 in FIG. 5 showing the plan view for the lower door lock assembly.

At the bottom end of the lower drop rod 66, an actuator is provided selectively to lock the bottom of door 2 to the center fixed bar 1 in either the fully open or fully closed position of the door. To this end, as best shown in FIGS. 5, 5A and 6, an actuator 68 mounted on the bottom of lower drop rod 66 has two steps 68A and 68B facing the front wall of hollow tubular bar 1. These two steps 68A and 68B cooperate with a ball plunger 69 to provide the locking and unlocking functions.

The ball 69 is supported by a ledge 70 mounted on the front wall of tubular bar 1. The ball 69 is confined for reciprocal movement through aperture 71 in the front wall of bar 1 by spaced side walls 72. The ball 69 may be partially received in hemispherical recess 73A in locking plate 74 at the left side of door 2 as shown in FIG. 1 or in hemispherical recess 73B in the right side of the door as viewed in FIG. 1. A cover plate 75 is mounted to the front wall of bar 1 to assist in concealing the lower ball lock and make it more difficult to tamper with the lower locking mechanism.

To effect extension of ball 69 into either door recess 73A or 73B, the lower drop bar 66 must be lowered so that step 68A engages the ball 69 to drive the same through aperture 71 into the door recess aligned therewith. This lower position of the actuator 68 and lower drop bar section 66 corresponds to the lower position of roller 56 and upper drop bar section 51. Therefore, when the solenoid 62 is deenergized and the door is either fully open or fully closed, the drop bar assembly 12 is free to drop under gravity resulting in the roller 56 being received in one of the two cut out shoulders 57 on the carriage assembly 11 and also resulting in ball 69 being received in one of the two hemispherical recesses on the door. The drop bar assembly in its lower latched position thus provides on upper and lower lock against carriage assembly and door movement. The drive engagement between the rack and pinion provides a third restraint to carriage movement.

If in the locked door position, someone attempts to release the bottom lock in spite of its concealment as shown in FIG. 5, the forced elevation of the lower actuator 68 will not result in elevation of the roller 56 because of the slip fit connection provided for the upper end of the lower drop bar 66.

To release the two door locks, the solenoid 62 is electrically energized simultaneously to elevate the upper and lower drop bar sections. The elevation of the upper drop bar removes roller 56 from carriage assembly shoulder 57 to unlatch the top lock. The simultaneous elevation of the lower drop bar 66 will result in the actuator 68 moving to the full line position shown in FIG. 5A. In such position, the shoulder 68B is not constraining the ball 69 to its position extended from the hollow tubular bar 1. Thereafter, when the door is open or closed, the hemispherical recess 73A or 73B will cam the ball in the direction of arrow 76 in FIG. 5A to release the ball 69 from partial receipt in the recess to allow the door to slide therepast. The upper and lower locking of the door and the opening or closing of the door are automatically controlled by the electrical control circuit indicated generally at 13.

Control Circuit 13

The control circuit, shown schematically in FIG. 7, includes two limit switches associated with the carriage assembly respectively to sense the fully closed or fully opened position of the door 2 and also includes two limit switches associated with the drop bar assembly to sense the drop bar up and unlatched condition or drop bar down and latched position. As best shown in FIG. 1, a limit switch 77 is mounted on the back wall 9 of transom 7 adjacent the right end of the transom as viewed in FIG. 1. The switch arm 77A of limit switch 77 is engaged by the right end of the rack 39 when the door 2 is in its fully closed position shown in FIG. 1. (As used herein switch arm and contacts to make or to break an electrical connection may be used interchangeably with and include a switch actuation of a switch, i.e. that which causes the actual switch arm to undergo movement, and vice versa). This engagement of the switch arm of limit switch 77 will close the switch contacts to signal that the door 2 is its fully closed position. Similarly, a limit switch 78 is mounted to the back wall 9 of transom 7 adjacent the left end of the transom as viewed in FIG. 1. The switch arm 78A of limit switch 78 will be engaged by the left end of rack 39 when the rack and door 2 are driven to their left limit as viewed in FIG. 1 thereby fully opening door 2. The engagement of the switch arm 78A of limit switch 78 will close the switch contacts electrically indicating a fully opened position of the door 2.

With respect to the drop bar assembly, a limit switch 80 is supported from the mounting plate 8 and has its switch arm 80A engaged by a shoulder 79 on the top of upper drop bar section 51 when the drop bar is in its lowered or latched position. The engagement of the switch arm 80A for limit switch 80 closes the switch contacts to electrically indicate a locked position of the door. Similarly, a limit switch 81 is supported from mounting plate 8 to indicate the drop bar up or unlatched condition. The switch arm 81A of limit switch 81 cooperates with a cam 82 mounted on upper drop bar 51. When the upper drop bar section 51 is elevated, the switch arm 81A is cammed upwardly to ride along the front face 82A of cam plate 82 to close the switch contacts of switch 81, thereby to indicate the latch up position of the drop bar assembly.

The four limit switches, the motor and the solenoid are identified in the electrical schematic of FIG. 7 with the same reference numerals used in the other figures. As will be apparent from FIG. 7, switch arm 81A is ganged with switch arm 84A so that these two switches open and close simultaneously. Switch arm 78A is ganged with switch arm 85A so that those two switch arms open and close simultaneously. The electrical control circuit of the locking and actuating mechanism of the present invention has a control panel which may be adjacent the door or at a position remote from the door. This control panel includes lights to indicate the status of the door and a three position control switch for opening and closing the door.

As is shown in FIG. 7, a green light 86 is provided in the control panel to indicate the door closed and door locked position. A red light 87 is also provided in the control panel and indicates that the door is open and unlocked or open and locked. Finally, the control panel includes the three position switch 88 having an "open" door position, an "off" or neutral position and a "close" door position. The switch 88 controls four ganged switch arms 88A–88D respectively cooperating with their associated contacts. The switch arms 88A–88D are shown in their neutral or "off" position in FIG. 7. Movement of the control switch to either the "open" or "close" position results in controlled selected movement of respective ones of the ganged switch arms 88A–88D, with these switch arms being programmed according to the door operating mode to condition control circuit of FIG. 7 for proper solenoid and motor operation as described in more detail below. The switch 88 is spring loaded to the neutral "off" position with the switch arms or contacts in the conditions shown in FIG. 7.

Power is provided to the electrical control circuit 13 by positive line 89 and negative power line 90. The motor 20 is electrically connected in line 91 including "latch up" switch arm 81A with parallel input lines 91A and 91B leading to separate terminals of motor 20. The motor direction of rotation when energized will depend on which of the lines 91A, 91B has power applied. Control switch arm 88A is in line 91A and control switch arm 88B is in line 91B. (Negative and positive labels applied to lines 89, 90 are for convenience only. The lines may be from a DC or an AC power supply).

The red light 87 at the control panel is electrically connected in line 92 leading between positive line 89 and negative line 90. Electrical line 92 includes parallel lines 92A and 92B. Switch arm 84A is positioned in line 92A and door open switch arm 78A is located in line 92B.

The drop bar solenoid 62 is electrically connected in electrical line 93 extending between positive line 89 and negative line 90. Electrical line 93 includes parallel electrical lines 93A extending to positive line 89 and 93B extending to node 94. The switch arms 85A and 88C are positioned in line 93A and control switch arm 88D is positioned in line 93B.

The green light 86 is electrically connected in electrical lead line 95 extending between positive line 89 and negative line 90. Lead line 95 includes door close switch arm 77A, latch down switch arm 80A and node 94.

The electrical circuit just described is shown in the condition corresponding to the door being closed, as sensed by switch arm 77A being closed, and the drop bar assembly being in a down or locked position as indicated by switch arm 80A being closed. In such condition of the electrical circuit, current flows through line 95 to illuminate the green light at the control panel to indicate to the observer that the door 2 is closed and locked. To initiate door opening, the control switch 88 at the control panel would be moved to the "open" position.

This manual movement of the control switch 88 to the "open" position results in switch arm 88A closing, switch arms 88B and 88C remaining open, and switch arm 88D closing. Electrical current will then flow through switch arm 77A and lines 93B and 93 to energize the latch solenoid 62. The energization of the latch solenoid will result in the drop bar assembly being elevated to release the roller 56 from the cut out shoulder 57 on the carriage assembly 11 and to release the ball 69 from the door recess. Such energization of the latch will occur before the motor 20 starts because the latch up switch 81 is still not closed.

When the drop bar assembly reaches its elevated position to close limit the switch arm 81A of switch 81, the motor 20 will be energized by current flowing through lines 91 and 91A. While the motor is operating, the solenoid will become deenergized and will remain inoperative because the switch arm 77A of limit switch 77 will open after the door 2 has moved a prescribed distance to the left. Such distance is a function of the physical overlap of the switch arm 77A and rack 39. Even though the latch solenoid 62 is deenergized during operation of motor 20, the drop bar assembly is mechanically restrained from returning to its latched position under gravity. In this regard, the roller 56 is supported on the upper surface of back plate 24 of carriage assembly 12. This mechanical support of roller 56 by the back plate 24 precludes the drop bar assembly from dropping to the latched condition until the door reaches its fully open position.

The switch 88 manually must be held in the "open" position during the entire opening operation; else the motor will deenergize. When the door has moved substantially completely to the left as viewed in FIG. 1, the ganged switch arms 78A and 85A are closed by the left end of rack 39 engaging switch arm 78A.

With the door open and solenoid deenergized, the drop bar assembly falls under gravity to its lowered position since the mechanical restraint has been removed. The roller 56 is then received in the right cut out slot 57 of the carriage assembly and the ball 69 has been cammed into hemispherical recess 73B by the step 68A on actuator 68. The door is then latched with two locks in its fully open condition. With the door fully opened and the drop bar assembly falling to the latched position, switch arms 81A and 84A are open and the motor 20 is deenergized to discontinue its operation regardless of whether or not the switch 88 continues manually to be held in "open" position. When switch 88 is released, it will return to its "off" position under spring bias to return switch arms 88A–88D their respective open positions.

Thus electrical line 93 and 93A are conditioned for latch solenoid operation upon initiating the door close cycle. The red light remains on while the door is opened and locked by electrical current flowing through line 92B with closed switch arm 78A and through line 92.

To initiate door closure, the main control switch 88 is moved from its off position to its "closed" position. In the closed position switch 88, switch arms 88A and 88D remain open and switch arms 88B and 88C close. Electrical power will initially be provided to solenoid 62 by current passing through line 93A with closed switch arms or contacts 85A and 88C and through line 93. Electrical current initially will not flow through the motor 20 at this time because latch up switch 81 is open. However, as solenoid 62 operates, the drop bar assembly is elevated to unlatch the upper and lower locks on door 2. When the drop bar assembly is elevated to the latch up position, switch arm 81A of limit switch 81 closes to energize the motor in reverse direction through line 91B. The motor then drives the door to the right through the rack and pinion drive. After the door has moved an adequate distance from its fully opened position (depending on the extent of overlap of the rack 39 and switch arm or actuator 78A), switch arms 78A and 85A open since the switch arm of switch 78 is no longer engaged by the traveling carriage assembly rack. By thus opening switch arm 85A, the latch solenoid is deenergized but the drop bar assembly does not fall to its latched position because of the mechanical restraint provided by carriage assembly 12. The red light 87 remains illuminated during door closure travel by current flowing through line 92A with closed switch 84A and line 92 to red light 87. The switch 88 manually is held in the "close" position during closing of the door.

When the door returns to its fully closed position, the door closed limit switch arm 77A moves to its closed position and the drop bar assembly falls to the latched position to close switch arm 80A. With the drop bar assembly falling to its latched position, switch arms 81A and 84A are opened and the circuit is returned to FIG. 7 condition with the green light on indicating that the door is in its closed and locked condition and the motor 20 deenergized.

Occasionally, the operator may discontinue the door opening (or closing) cycle before the door fully opens (or closes) by manually moving the control switch 88 to its neutral position. If this happens, the control switch 88 may thereafter be manually returned to the "close" position or "open" position to resume or to reverse the door movement operation generally as is described above. In such case the latch up switch arm would still be closed by mechanical restraint to allow the motor to be restarted in the selected direction.

As will be apparent, multiple doors can also be operated using the actuation and locking mechanisms of the present invention. The control circuit 13 as illustrated in FIG. 7 can be repeated in the same circuit pattern for as many doors as desired. In such case, a master switch will be provided at the control panel to operate all the doors simultaneously in addition to individual control switches 88 being provided selectively to operate each door independently of the others.

Occasionally, electrical failure or malfunction can result in the electrical circuit 13 being wholly or partially inoperative. If this occurs, the emergency release assembly 14 of the present invention may be manually actuated to allow the door 2 to be manually opened, closed, locked or unlocked, as required under the circumstances.

Emergency Release Assembly 14

The emergency release assembly 14 includes a lever 97 which is pivotally connected to the mounting plate 8 as indicated at 98. A coil spring 99 is connected between the mounting plate 8 and the lever 97 normally to bias lever 97 in a clockwise direction as viewed in FIGS. 1 and 2. The pivotal bias of lever 97 is used normally to maintain the pivotal motor assembly 10 in the operative position shown in FIGS. 1 and 2.

To this end, the lever 97 has an adjustable finger 100 thereon. The bottom of finger 100 is adjusted to bear against the top surface of motor base 18 to retain the motor base and thus the motor and pinion in the operative position shown automatically to drive the carriage assembly 11 when actuated. However, the lever 97 can also be used to disengage the motor assembly and the drop bar assembly if electrical power is out or if the electrical circuit is malfunctioning.

For this purpose, an emergency release cable 101 is connected to the top of the upper section of lever 97. If emergency release cable 101 is pulled to the left as viewed in FIGS. 1 and 2, the lever 97 will be driven in a counter-clockwise direction about pivot 98. With counter-clockwise movement of lever 97, a shoulder 103 on the lower section of lever 97 engages and pivotally moves motor base 18. The continued counterclockwise rotation of lever 97 will arcuately swing motor base 18 in a clockwise direction about the pivot shaft 16. This arcuate movement of motor base 18 is operative to disconnect the motor assembly and to unlatch the drop bar assembly.

Specifically, the arcuate movement of motor base 18 will lift pinion 21 from its meshed drive engagement with the teeth on rack 39. The rack 39 axially moves slightly to the left against the bias of spring 49 during pinion withdrawal to allow disengagement without damage to the respective teeth on pinion 21 and rack 39.

With respect to unlatching the drop bar assembly, the arcuate movement of motor base 18 results in the emergency release bolt 54 on the upper drop bar 51 being engaged. Continued arcuate movement of motor base 18 results in the drop bar assembly being driven upwardly driven due to the abutment between the emergency release bolt 54 and motor base 18, with this upward movement of the drop bar assembly removing roller 56 from cut out 57 and releasing ball 69 from its extended position in recess 73A or recess 73B.

With the drive and locks manually disengaged and with the lever 97 held against the bias of spring 99 in its release position, the door 2 may be manually opened or closed. When the door is either fully opened or fully closed, release of tension on cable 101 will result in lever 97 swinging in a clockwise direction under the bias of spring 99. Return of the lever 97 to its normal position will result in the drop bar assembly assuming its lowered locked mode and in the pinion 21 reengaging the rack 39 to condition the door for normal operation with automatic electrical control. Although the operation of the door is believed apparent from the above description, a brief operational statement is given hereinafter.

Operation of the Latching and Locking Mechanism

This operational statement begins with the assumption that the door 2 is closed and locked. The door opening sequence is begun by moving the three position master control switch 88 to the "open" position. The drop bar assembly 12 will then be actuated to unlatch the top and bottom locks with the motor thereafter being automatically energized to drive the door 2 to its fully opened position. The electrical system senses the door reaching its fully open position to trigger deenergization of the motor 20 followed by the drop bar assembly falling to the fully locked position. The control panel will exhibit the red light to indicate to the operator that the door is open and locked or unlocked.

To close and lock the door, the operator moves the three position switch to its closed position. The electrical control circuit then actuates the solenoid to unlatch the drop bar assembly with the motor thereafter being energized to return the door to its closed position through the rack and pinion drive. When the fully closed position is attained, the switch 77 senses closure and deenergizes the motor allowing the drop bar assembly to fall to its fully latched position.

If a power outage or electrical problem occurs, manual operation of the door 2 can be implemented through the emergency release control means. To accomplish this purpose, the emergency control cable 101 is pulled to the left as viewed in FIGS. 1 and 2. The cable 101 preferably terminates at the control panel and is operated by a manual lever (not shown) at the control panel. Suitable indicia are provided adjacent the manual lever in the control panel to indicate the position of the emergency release system. If more than one door is being controlled from the control panel, each door will have a manual lever at the control panel with a master lever being present to simultaneously actuate all manual levers. This control panel system allows individual doors to be manually opened or all doors to be simultaneously manually opened as required by the circumstances.

When the manual lever is pulled to the release position the emergency cable 101 is pulled to the left to pivot the lever 97 in a counter-clockwise direction to in turn pivot the motor assembly about the shaft 17. This pivotal movement of motor assembly 10 disengages the pinion 21 from rack 39 and drives the drop bar assembly upwardly to its unlatched position. The door 2 may then be manually moved between open and closed positions.

When the manual lever is returned to its normal operative position, the bias of spring 99 pivots lever 97 in a clockwise direction to return motor base 18 to its horizontal position to reengage the drive pinion and to release the drop bar assembly. The drop bar assembly can then complete the dual lock function without power when the door is either in the fully open or fully closed position by returning under gravity to its lower latched position. When power is resumed, the drop bar assembly and the motor assembly are in position to begin automatic operation when electrical power is restored or when the electrical problem is corrected.

For servicing purposes, substantially all of the locking and latching mechanism is readily accessible by removing the front wall of transom 7. The motor assembly can be disconnected from its pivotal shaft and removed. The door can also be removed by disconnecting fasteners 32 allowing the door 2 and hangar 31 to be lowered vertically downwardly until they clear the bottom of the transom 7. The carriage assembly 12 may then be readily removed by lifting the same off track 28. The drop bar assembly may also be readily removed by withdrawing bolt 58 and guide cover 53. The mounting plate 8 can then be removed by disconnecting the fasteners securing the same to the back wall 9 of transom 7. Removal of mounting plate 8 provides ready access to the solenoid 62 and the lower drop bar section through the aperture 105 in the front wall of the hollow bar 1. The solenoid can be slid into and out of the hollow tubular bar 1 and the entire lower drop bar section can be removed through aligned apertures in back wall 9 of transom 7 and the front wall of tubular bar 1. The installation or replacement of these components is also readily performed by reversing the removal functions just described.

The ease of service and installation is coupled with a fail safe mode of operation with no exposed actuation and locking parts. The locking and latching mechanism is also adapted to multiple door systems and to right or left hand doors. To change to a left hand door from a right hand door, the only changes required are in the electrical switching system to reverse the motor drive orientation consistent with the reversal in the door opening and closing functions.

It will be apparent from the foregoing that changes may be made in the details of construction and configuration without department from the spirit of the invention as defined in the following claims.

I claim:

1. An actuation and locking mechanism for a slidable prison door or the like comprising a mounting plate removably secured in an enclosed transom over the door, a pivotal motor assembly removably mounted on said mounting plate and including a selectively driven pinion, a selectively movable carriage assembly in the transom having a rack thereon normally in mesh with the pinion and having the door suspended therefrom, a drop bar assembly including a drop bar mounted on and selectively vertically driven relative to the mounting plate, the drop bar having lock means thereon which lock the carriage assembly in the locked position of the drop bar to preclude carriage assembly and door movement and which unlock the carriage assembly in an unlocked position of the drop bar to allow the carriage assembly and door to be slidably driven by the rack and pinion upon motor actuation, and an emergency release assembly pivotally mounted on the mounting plate normally to hold the pivotal motor assembly in place with the pinion in mesh with the rack, said emergency release assembly upon actuation pivoting the pivotal motor assembly to disengage the pinion from the rack and moving the drop bar to the unlocked position wherein the lock means unlocks the carriage assembly to allow the door to be manually opened or closed.

2. The actuation and lock mechanism of claim 1 wherein the transom has a bottom wall with an elongated slot therein slidably receiving a hanger extending between and respectively connected to the carriage assembly and door.

3. The actuation and locking mechanism of claim 2 further comprising slide means in the transom covering any exposed portion of the elongated slot.

4. The actuation and locking mechanism of claim 3 wherein the slide means includes an elongated slide member confined for sliding movement along the bottom wall of the transom above the elongated slot therein, the elongated slide member having a second elongated slot therein through which the hanger extends for limited movement relative to the slide member.

5. The actuation and locking means of claim 4 wherein the second elongated slot has spaced ends selectively engaged by the moving hanger to drive the slide member with the door during part of its movement continually to cover any exposed portions of the first elongated slot resulting from the door movement.

6. The actuation and locking mechanism of claim 2 wherein the carriage assembly includes spaced wheels rotatably mounted thereon which ride along and are supported by a track extending upwardly from the bottom wall of the transom.

7. The actuation and locking mechanism of claim 6 wherein the carriage assembly has a cut-out shoulder at each end thereof respectively selectively receiving a roller on said drop bar constituting part of said locking means when the drop bar is in its locked position.

8. The actuation and locking mechanism of claim 7 wherein the drop bar has an upper section with the roller mounted thereon and a lower section with an actuator mounted on the bottom thereof, said actuator forming part of said locking means and selectively actuating a plunger into extended receipt in a door socket to restrict door movement when the drop bar is in its locked position.

9. The actuation and locking mechanism of claim 8 wherein the actuator has two steps thereon and the plunger is a partially constrained ball cooperating with the steps on said actuator to extend into said door socket when received in one step and to be withdrawn from said door socket when received in the other step.

10. The actuation and locking mechanism of claim 8 wherein the lower drop bar section has a slip mount relative to the upper drop bar section whereby the upper and lower sections normally move upwardly and downwardly together when the upper section is driven, but the lower section is free to move independently of the upper section if the lower section is manually raised.

11. The actuation and locking mechanism of claim 10 wherein the door slides relative to fixed and laterally spaced hollow bars and the lower section of the drop bar and the actuator mounted thereon are received in one of said fixed hollow bars.

12. The actuation and locking mechanism of claim 11 wherein said actuator forces said plunger to extend in door restraining engagement from or allows said plunger to be fully received in said fixed hollow bar.

13. The actuation and locking mechanism of claim 12 wherein the drop bar assembly includes a solenoid slidably and removably received in said fixed hollow bar, said solenoid selectively raising said drop bar into its unlocked position when the solenoid is energized and dropping said drop bar under gravity into its locked position when the solenoid is deenergized and when the door is fully open or fully closed.

14. The actuation and locking mechanism of claim 2 wherein the emergency release assembly includes a pivoted lever having an adjustable finger mounted thereon which normally engages a top surface of a base plate for the pivotal motor assembly to hold the pinion in mesh with the rack.

15. The actuation and locking mechanism of claim 14 wherein the pivoted lever is spring biased to urge the lever and finger into engagement with the base plate positively to retain the pinion in mesh with the rack.

16. The actuation and locking mechanism of claim 15 wherein the pivoted lever has a shoulder thereon abutting the bottom surface of the base plate.

17. The actuating and locking mechanism of claim 16 wherein the lever has a manually actuated emergency release cable connected thereto and extending therefrom operative upon actuation to pivot the lever against the spring bias resulting in the arcuately moving lever shoulder pivoting the motor assembly to elevate the pinion from the rack and to elevate the drop bar to its unlocked assembly.

18. The actuation and locking mechanism of claim 17 wherein the drop bar has a projection thereon which is engaged by the upper surface of the base plate upon pivotal movement of the base plate to elevate the drop bar to its unlocked position.

19. The actuating and locking mechanism of claim 18 wherein the rack is mounted on the carriage to permit slight axial movement of the rack relative to the carriage when the pinion is being elevated from the rack.

20. The actuating and locking mechanism of claim 19 wherein the fastener means extending from the carriage to the rack pass through slots in the carriage to permit slight axial movement of the rack relative to the carriage and spring means between the carriage and rack normally to retain a fixed relationship between the carriage and rack by urging the fastener means against the respective ends of the slots.

21. The actuating and locking mechanism of claim 2 wherein the drop bar assembly includes a solenoid selectively operative when actuated to raise the drop bar to its unlocked position and selectively operative when deactuated to drop the bar under gravity to its locked position when the door is fully open or fully closed.

22. The actuation and locking mechanism of claim 21 further comprising a control means to actuate the motor and/or solenoid as required to open, close, lock or unlock the door.

23. The actuation and locking mechanism of claim 22 wherein the control means includes a first switch to sense the unlocked position of the drop bar, a second switch to sense the locked position of the drop bar, a third switch to sense the fully closed condition of the door and a fourth switch to sense the fully opened position of the door.

24. The actuation and locking mechanism of claim 23 wherein the control means includes a green light to indicate the closed and locked position of the door and a red light to indicate the open, unlocked or both the open and unlocked position of the door.

25. An actuation and locking mechanism for sliding prison doors or the like comprising a pivotal motor assembly centrally located above the door to open and close left or right hand doors, a movable carriage assembly reciprocally driven by the motor assembly through a rack and pinion drive, said carriage assembly carrying the door, a drop bar assembly normally operated by a solenoid selectively for locking or unlocking the carriage assembly and door, control means for actuating the motor and drop bar assembly as required to open, lock open, close, lock close the door, and emergency release means to disengage or engage the drop bar assembly and pivotal motor assembly to allow the door to be manually opened, closed, unlocked or locked.

26. The actuation and locking mechanism of claim 25 wherein the pivotal motor assembly and carriage assembly are removably mounted in an enclosed transom above the sliding door.

27. The actuation and locking mechanism of claim 26 wherein the pivotal motor assembly includes the pinion normally in mesh with a rack on the movable carriage, whereby the pinion drives the carriage when the motor is energized.

28. The actuation and locking mechanism of claim 27 wherein the emergency release means includes a manually operable lever to pivot the pivotal motor assembly away from the rack and carriage to disconnect the pinion from the rack and to move the drop bar assembly to a position unlocking the door.

29. The actuation and locking mechanism of claim 28 wherein the manually operable lever is spring biased to a position normally holding the pinion in mesh with the rack with the drop bar assembly free to assume its locked position.

* * * * *